US007287720B1

(12) United States Patent
Allegre et al.

(10) Patent No.: US 7,287,720 B1
(45) Date of Patent: Oct. 30, 2007

(54) PAPER TOWEL DISPENSER

(76) Inventors: Marc Allegre, 3128 Downs Cove Rd., Windermere, FL (US) 34786; Patrice Minguez, 9503 Portbury Dr., Orlando, FL (US) 32836

( * ) Notice: Subject to any disclaimer, the term of this patent is extended or adjusted under 35 U.S.C. 154(b) by 403 days.

(21) Appl. No.: 11/083,675

(22) Filed: Mar. 18, 2005

(51) Int. Cl.
*B65H 18/02* (2006.01)

(52) U.S. Cl. ..... 242/593; 221/63; 220/253; 206/409

(58) Field of Classification Search ..... 242/593, 242/132, 137, 146, 615.3, 615.4; 206/409, 206/390, 394, 205, 210, 812; 220/253; 221/1, 221/62, 63
See application file for complete search history.

(56) References Cited

U.S. PATENT DOCUMENTS 5,141,171 A * 8/1992 Yang ..... 242/593
5,215,211 A * 6/1993 Eberle ..... 221/1
5,370,338 A * 12/1994 Lewis ..... 242/593
5,577,634 A * 11/1996 Morand ..... 221/43
6,089,499 A * 7/2000 Robinson ..... 242/593
6,267,321 B1 * 7/2001 Tramontina ..... 242/593
6,328,252 B1 * 12/2001 Neveu et al. ..... 242/593
6,575,397 B1 * 6/2003 Tramontina et al. ..... 242/593
6,869,041 B1 * 3/2005 Allegre et al. ..... 242/593

* cited by examiner

*Primary Examiner*—William A. Rivera
(74) *Attorney, Agent, or Firm*—Allen, Dryer, Doppelt, Milbrath & Gilchrist, P.A.

(57) ABSTRACT

An apparatus and method for dispensing a single paper towel from a continuous paper towel roll includes a housing having a housing back and a front cover connectable thereto for opening and closing the housing. A dispensing opening is positioned along a periphery of the housing, the dispensing opening defined at least partly by the housing back and at least partly by the front cover; a paper retainer member associated with the front cover and positioned to guide through the dispensing opening a tail of a paper towel roll positioned in the housing; and a piston assembly comprising a biasing member and a piston responsive thereto, the piston assembly connected to the housing so that the piston contacts the tail of a paper towel roll extending through the dispensing opening. The dispenser is magnetically attachable to a ferrous metal surface.

21 Claims, 6 Drawing Sheets

PAPER TOWEL DISPENSER

RELATED PATENT AND APPLICATION

This application claims priority from co-pending application Ser. No. 10/356,026 which was filed on Jan. 31, 2003, and which claimed priority from provisional application Ser. No. 60/353,325 which was filed on Feb. 1, 2002, both applications being incorporated herein by reference in their entirety.

FIELD OF THE INVENTION

The present invention relates to the field of dispensers, and more specifically to a paper towel dispenser having a mechanism for dispensing one paper towel at a time.

BACKGROUND OF THE INVENTION

Dispensers for roll paper towels have been well known for some time. Such dispensers are commonly placed in lavatories, near sinks, and in public restrooms to enable users to dry their hands after washing. Typically, a paper towel dispenser is mounted on a wall adjacent a sink or other handwashing station. The dispensers are usually hand operated by the user, and dispense a length of paper towel according to pulling action by the user. Some dispensers are provided with an actuating mechanism for dispensing the paper towels, and also intended to help prevent unchecked dispensing of the paper towels, which causes waste of paper.

The prior art includes various attempts to design paper towel dispensers having mechanisms for preventing excess dispensing of paper towels. A typical approach to this problem is some type of metering mechanism requiring a user to push an activating button or lever, or wait a predetermined time before another paper towel can be pulled from the dispenser. For example, U.S. Pat. No. 4,664,304 issued to Wendt et al. describes a metering mechanism having a button which must be depressed by the user for each predetermined amount of paper towel to be dispensed. As shown in the figures, such an actuating button is typically interconnected with a drive mechanism or other moving parts which function in the act of dispensing. At times, gears and other moving parts connected to the button will break or disengage therefrom, rendering the button useless.

Because of the materials used in a work area or for ease of cleaning, locations where paper towel dispensers are commonly found are designed with ferrous metal surfaces that make attachment by conventional fasteners difficult. In particular, for example, wall partitions dividing stalls in a restroom facility are likely to be manufactured of metal, usually a ferrous metal. The skilled will recognize that the term "ferrous" as described in standard English dictionaries means "containing iron." A ferrous metal, for example, will display magnetic attraction, so that a magnet will attach to the metal. Accordingly, an embodiment of this invention is contemplated that would allow conventional fasteners to be replaced by one or more magnets for attaching the dispenser to ferrous metal walls or surfaces. This feature would eliminate the need to drill one or more holes into the metal surface in order to attach the dispenser, thus preventing the potential for corrosion between the fastener and the metal wall and greatly facilitating the installation process.

In view of the foregoing, there continues to be a need for a roll paper towel dispenser structured to provide a user with a single paper towel at a time, and not requiring any affirmative action by the user, other than pulling out the paper towel. Additionally, a roll paper towel dispenser having a metering mechanism not easily accessible to a user would be more tamper resistant and would help prevent intentional damage to the dispenser. Further, a dispensing control mechanism that is relatively simple, inexpensively fabricated, and easily maintained would be advantageous.

SUMMARY OF THE INVENTION

With the foregoing in mind, the present invention advantageously provides a dispenser for dispensing paper towels from a continuous paper towel roll wherein each individual towel is separated from an adjoining towel by a plurality of perforations. The dispenser is adapted for dispensing a single paper towel at a time, and comprises a housing, a dispensing opening, a paper retainer member, and a piston assembly. The housing has a housing back and a front cover hingedly connected thereto for opening and closing the housing. A dispensing opening is positioned along a periphery of the housing, the dispensing opening being defined at least partly by the housing back and at least partly by the front cover. The paper retainer member is associated with the front cover and is positioned to guide through the dispensing opening a tail of a paper towel roll positioned in the housing. A piston assembly comprising a biasing member and a piston responsive thereto is connected to the housing so that the piston contacts the tail of a paper towel roll extending through the dispensing opening.

In a preferred embodiment of the invention the dispensing opening forms an outlet for a generally funnel shaped paper guide positioned along a lower periphery of the housing, the funnel shape being at least partly defined by the housing back and the front cover. Additionally, the housing comprises a wall mounting connector having a plurality of openings for therethrough receiving fasteners, a preferred wall mounting connector member having a plurality of openings for therethrough receiving fasteners, the connector member being releasably engageable with the housing back.

The inventive paper towel dispenser preferably further comprises an advertising display member releasably engageable with the housing. The display member may be releasably engageable with the housing so as to extend upwardly therefrom when engaged. The housing also includes a lock positioned to lock the front cover to the housing back so that the housing is securely closed. A paper support shelf may form a lower portion of the housing for thereon supporting a paper towel roll. The front cover further comprises a rib member which supportingly contacts the paper retainer member when the front cover is closed relative to the housing back In the dispenser, the piston assembly may comprise a piston housing supporting piston in responsive contact with the biasing member. The biasing member comprises a compression spring, but the skilled will understand that other biasing devices may be employed as well and are intended to be covered within the scope of the invention. The piston assembly is removably connected to the housing, so that it is easy to replace the piston assembly, preferably without the need for tools.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which.

DETAILED DESCRIPTION OF THE PREFERRED EMBODIMENT

Figure 1:
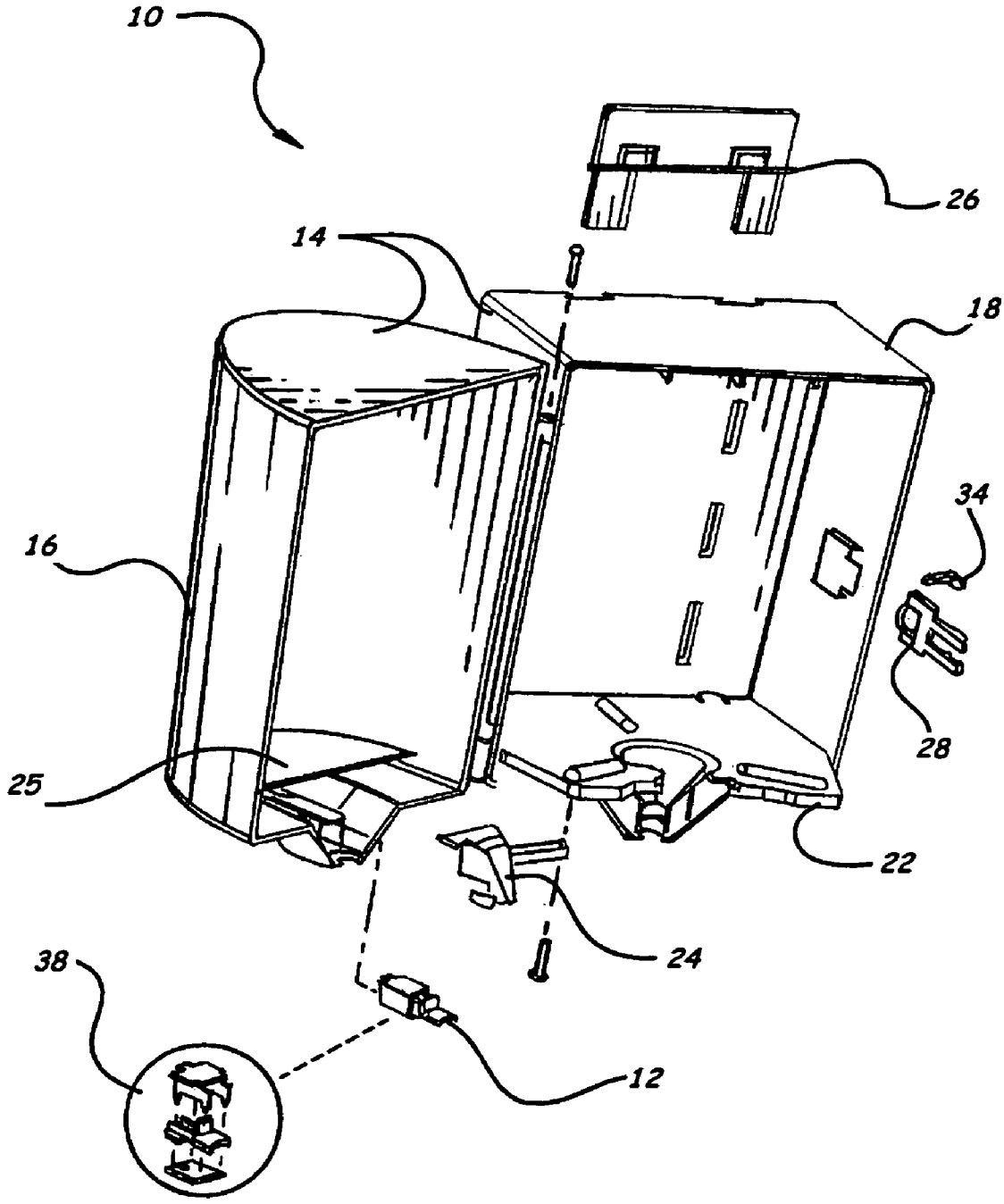
FIG. 1 shows an overall front perspective view of the paper dispenser of the present invention.

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, or other sources mentioned herein are incorporated by reference in their entirety. In case of conflict, the present specification, including any definitions, will control. In addition, the materials, methods and examples given are illustrative in nature only and not intended to be limiting. Accordingly, this invention may, however, be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

The present invention, as shown in FIGS. 1-4, discloses a dispenser 10 for dispensing paper towels from a continuous paper towel roll wherein each individual towel is separated from an adjoining towel by a plurality of perforations. The inventive dispenser 10 comprises a housing 14 having a housing back 18 and a front cover 16 connectable thereto for opening and closing the housing, the front cover being preferably hingedly connected to the housing back. A dispensing opening 36 is positioned along a periphery of the housing 14, the dispensing opening being defined at least partly by the housing back 18 and at least partly by the front cover 16. A paper retainer member 24 is associated with the housing 14 and positioned to guide through the dispensing opening 36 a tail of a paper towel roll positioned in the housing 14. The dispenser 10 also comprises a biasing member 38 and a piston 40 responsive thereto, a piston assembly 12 being connected to the housing 14 so that the piston 40 contacts the tail of a paper towel roll inserted through the dispensing opening 36.

Figure 2:
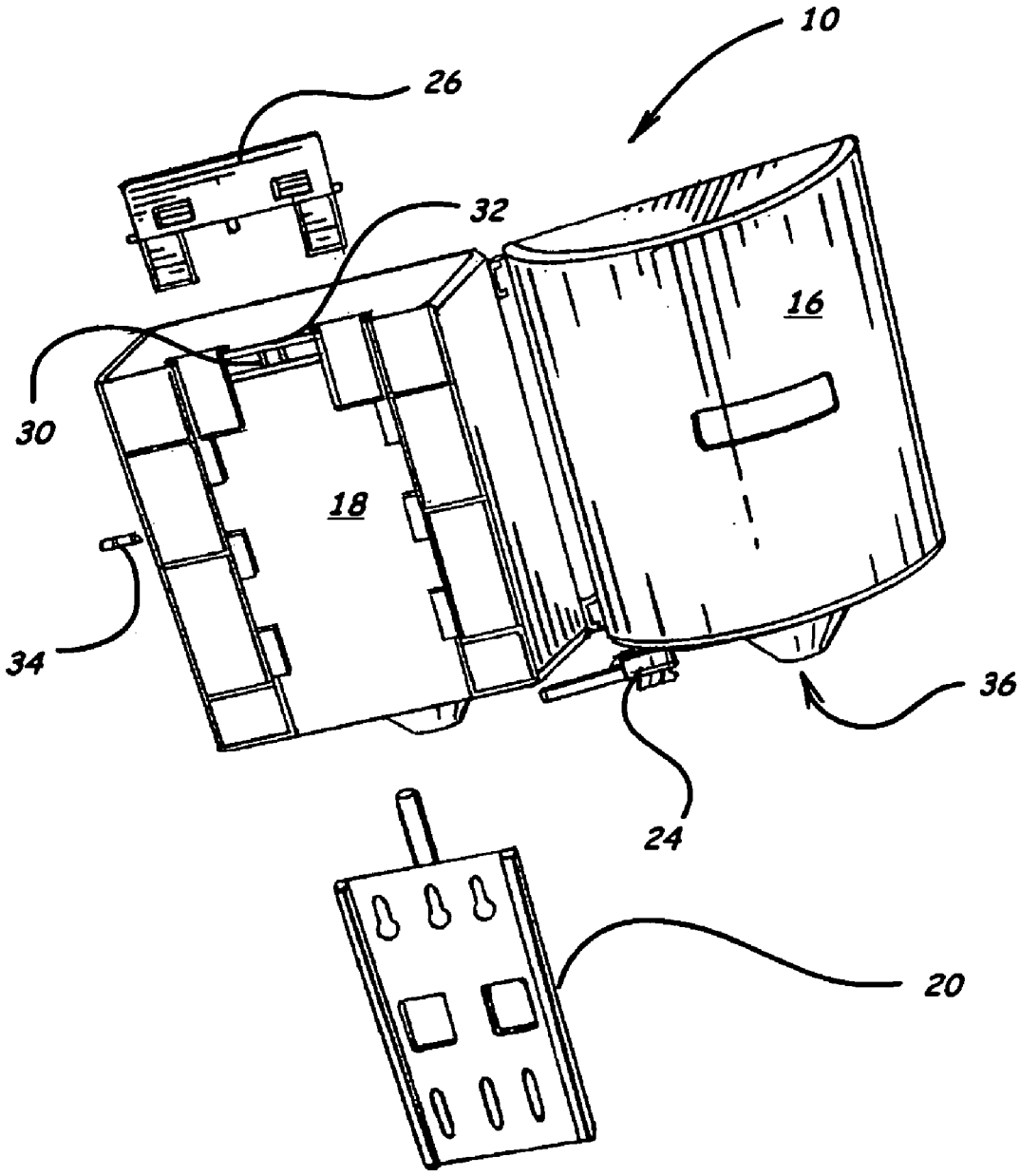
FIG. 2 is a back perspective view of the paper dispenser of FIG. 1.

In a preferred embodiment of the invention, the housing 14 further comprises a wall connector member 20 having a plurality of openings for therethrough receiving fasteners. Most advantageously, the connector member 20 may be releasably engageable with the housing back 18, so that the housing 14 may be easily dismounted from the wall without the need for dismounting the connector member itself. Such an arrangement is illustrated in FIG. 2.

Figure 6:
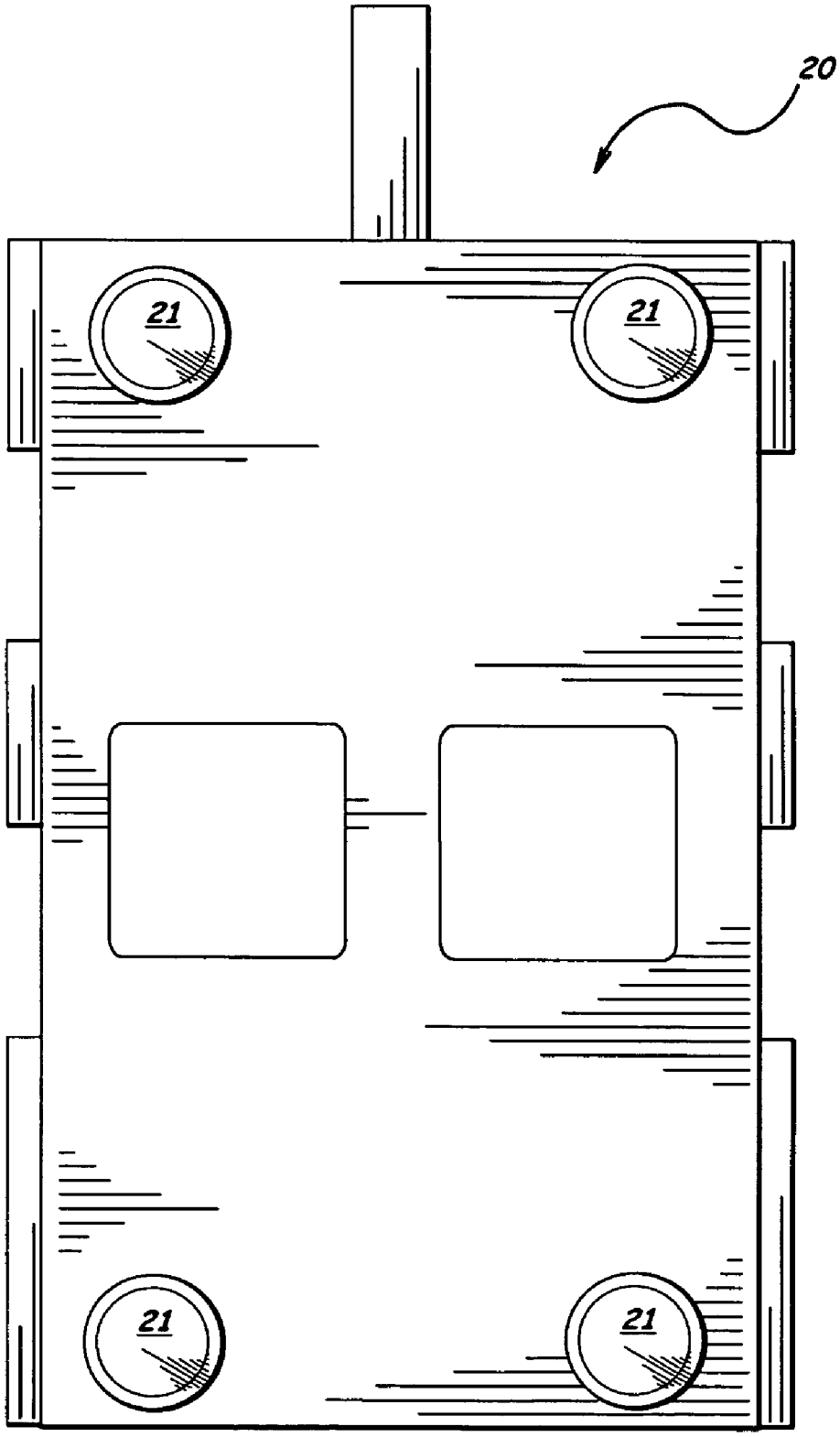
FIG. 6 is a diagram of the wall mounting connector depicting one arrangement of magnets for attaching the dispenser to ferrous walls or other surfaces.

In another embodiment of the invention, the dispenser housing 14 is contemplated as having at least one magnet 21 for attaching the dispenser to a ferrous metallic surface. The magnet or magnets may be mounted directly on the dispenser housing. Alternatively, the dispenser housing may comprise a wall mounting connector member 20, having a plurality of magnets for attaching the dispenser to a ferrous metallic surface, as shown in FIG. 6, so that the connector member can be releasably engageable with the housing back.

The dispenser 10 may additionally include an advertising display member 26, preferably releasably engageable with the housing 14. The advertising display member 26 may be releasably engageable with the housing 14 so that it extends upwardly therefrom when engaged, for added visibility of the advertisement, and so as to be easily removable from the housing for changing advertisements. For security, the dispenser housing 14 may be disposed with a lock 28 positioned to lock the front cover 16 to the housing back 18 so that the housing is securely closed. The housing 14 may additionally include a paper support shelf 22 forming a lower portion of the housing for thereon supporting a paper towel roll. Further, the front cover 16 may be disposed with a rib member which supportingly contacts the paper retainer member 24 when the front cover is closed relative to the housing back 18.

Figure 3:
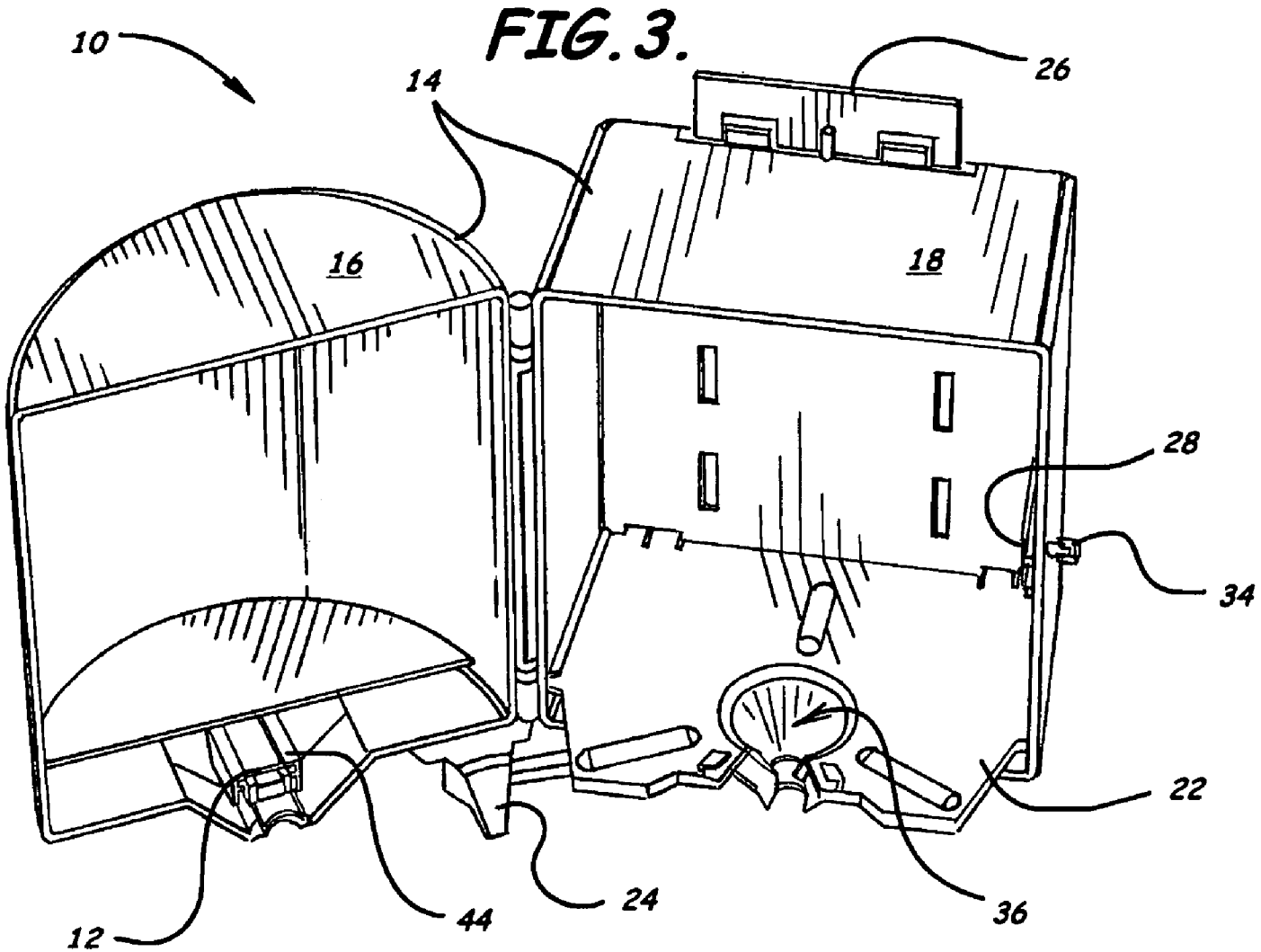
FIG. 3 is an additional front perspective view of the dispenser of FIG. 1.
Figure 4:
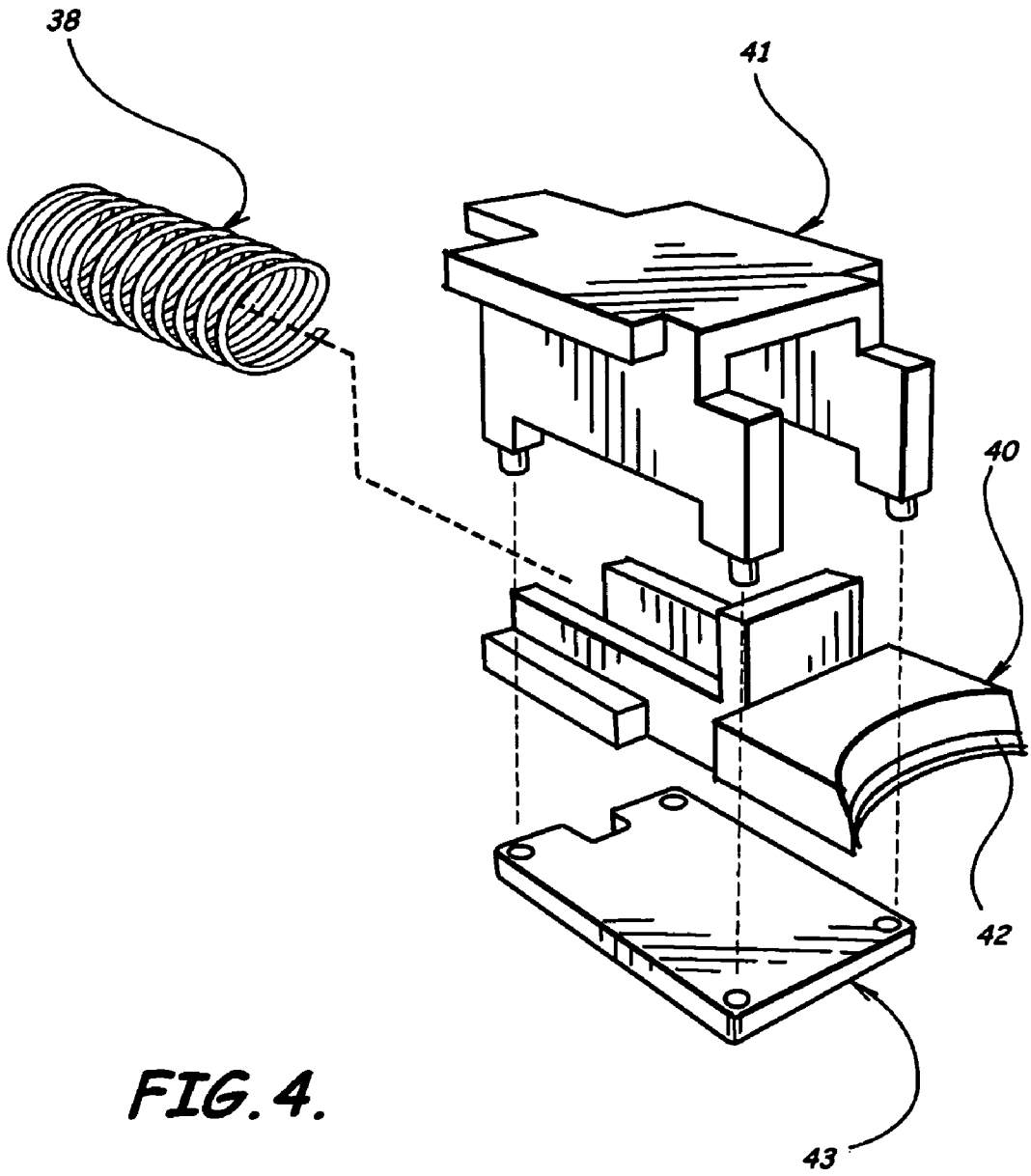
FIG. 4 is an exploded view showing detail of the piston assembly of the present invention.

In a preferred embodiment of the paper towel dispenser 10, the dispenser 10 further comprises a piston housing 46, shown in FIG. 4, supporting piston 40 in responsive contact with the biasing member 38. Biasing member 38 preferably comprises a compression spring, however, the skilled will understand that other biasing devices known in the art may be employed in place of a compression spring, and the invention is intended to include such other biasing devices. Preferably, the dispenser 10 is removably connected to the housing, as may be appreciated from FIGS. 1 and 3.

In yet another preferred embodiment of the paper towel dispenser 10, the dispensing opening 36 forms an outlet for a generally funnel shaped paper guide 42 positioned along a lower periphery of the housing, the funnel shape being at least partly defined by the housing back 18 and the front cover 16, as shown in FIGS. 1 and 3. The paper retainer member 24 is positioned in the housing to guide through the dispensing opening 36 the tail of a paper towel roll positioned in the housing. Preferably, the paper retainer member 24 abuts the paper guide 42 and at least partly defines the general funnel shape, as best seen in FIG. 3. A dispenser 10 comprising a biasing member 38 and a piston 40 responsive thereto is connected to the housing so that the piston contacts the tail of a paper towel roll extending through the dispensing opening 36. The dispenser 10 may also comprise a piston housing 46 supporting piston 40 in responsive contact with the biasing member 38. As noted above, the skilled will understand that a preferred biasing member 38 comprises a compression spring, however, the invention is intended to cover other suitable biasing devices in addition to a compression spring. Most preferably, the dispenser 10 is removably connected to the housing so that the piston 40 may be easily changed, even without the use of tools.

Figure 5:
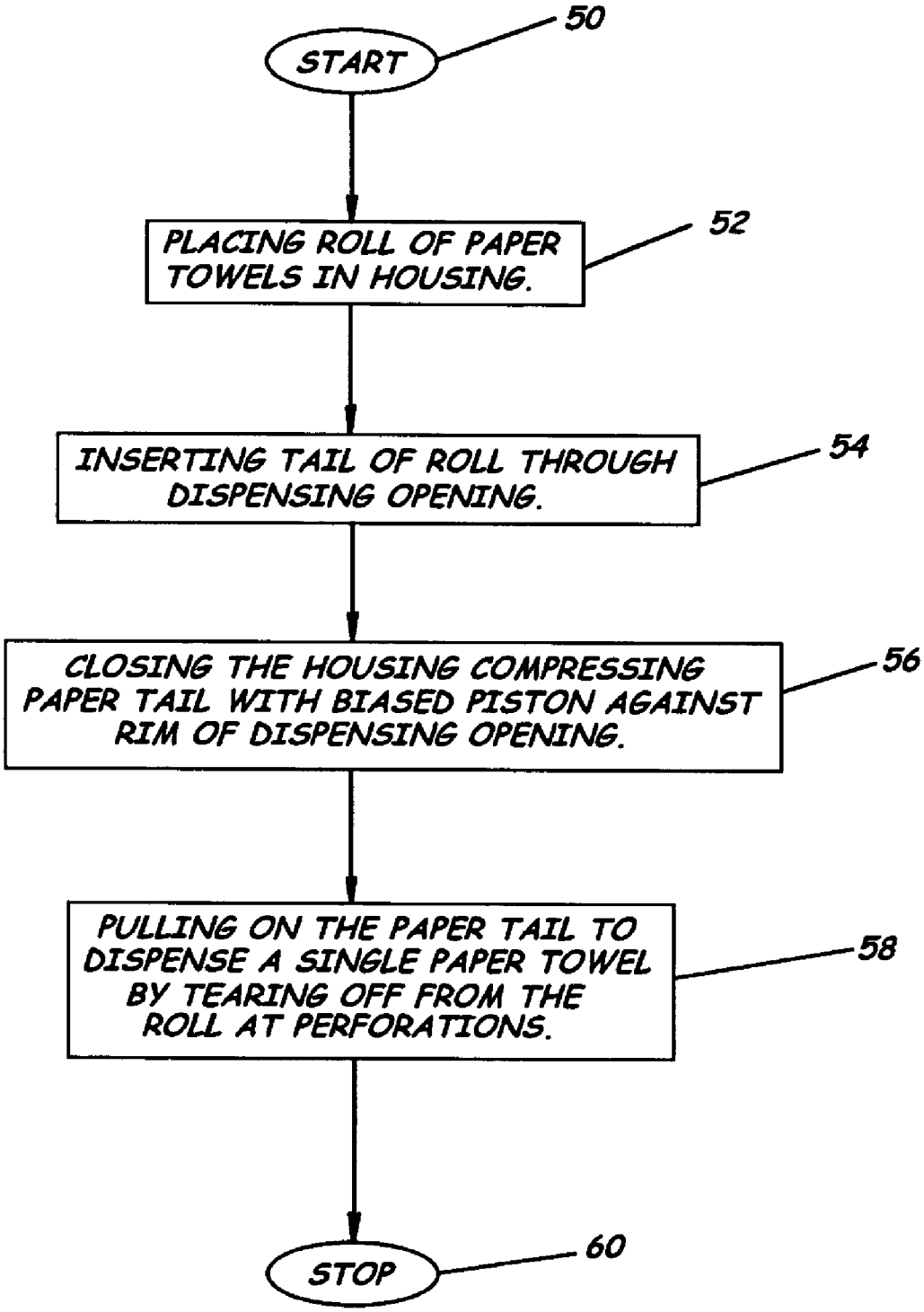
FIG. 5 is a block diagram illustrating a method of the invention.

Method aspects of the invention are illustrated in the block diagram shown in FIG. 5. The method is for dispensing one paper towel at a time from a continuous roll of paper having a plurality of spaced apart lines of perforations therebetween defining individual paper towels. The method starts 50 by placing 52 the roll of paper in a housing 14 having a housing back 18 and a front cover 16 hingedly connected thereto for opening and closing the housing. The method continues by inserting 54 a tail of the roll of paper through a dispensing opening 36 forming an outlet for a generally funnel shaped paper guide 42 positioned along a lower periphery of the housing, wherein the funnel shape is at least partly defined by the housing back and the front cover. Closing 56 the housing continues the method to thereby contact the tail inserted through the dispensing opening with a biased piston 40 compressing the tail against a rim of the dispensing opening. Pulling 58 on the tail inserted through the dispensing opening causes the biased piston to generate sufficient friction against the paper to tear the roll along a line of perforations so as to dispense a single towel. Thereafter, the method stops 60.

The method further includes mounting the housing to a wall by a mounting connector having a plurality of openings for therethrough receiving fasteners. Mounting the housing to a wall is accomplished by a mounting connector having a plurality of openings for therethrough receiving fasteners, wherein the mounting connector is releasably engageable with the housing back 18. Alternatively, the method for mounting the housing to a ferrous metal wall may also be accomplished by magnetically attaching the dispenser housing when the receiving fasteners are replaced by at least one magnet incorporated into the back wall of the housing. In yet another embodiment of the invention, the wall mounting connector member is disposed with a plurality of magnets for attaching the dispenser to the ferrous metal surface, the connector member being releasably engageable with the housing back.

The method also includes displaying an advertisement on a display member releasably engageable with the housing, wherein the display member is preferably releasably engaged with the housing so as to extend upwardly therefrom. Locking the front cover 16 to the housing back 18 is part of the method so that the housing is secure when closed. Additionally, the method calls for providing a paper support shelf 22 forming a lower portion of the housing 14 for thereon supporting a paper towel roll, and providing in the front cover 16 a rib member which supportingly contacts the paper retainer member 24 when the front cover is closed relative to the housing back 18.

In another embodiment of the method, the dispenser 10 further comprises a piston housing 46 supporting piston 40 in responsive contact with the biasing member 38, the biased piston preferably including a compression spring. As noted above, however, the invention is intended to include other biasing devices in addition to a compression spring. Most preferably in the method, the biased piston 40 is removably connected to the housing.

Further aspects of the method of the invention include positioning a paper retainer member 24 in the housing to guide through the dispensing opening 36 the tail of the paper towel roll, wherein the paper retainer member preferably abuts the paper guide 42 and at least partly defines the general funnel shape.

In operation of the invention, the dispenser apparatus 10 is typically installed on a wall by attaching the wall mount member 20 to a wall surface and engaging the dispenser apparatus with the wall mount until the dispenser snaps into position. The present dispenser 10 may, however, be installed in any other manner desired by the user, as the novel dispenser 10 will function properly with the dispenser positioned in any orientation.

As illustrated in FIG. 2, the dispenser apparatus 10 is mounted on a surface by first attaching the wall mount member 20 to the desired surface. Once this wall mount member 20, or mounting plate, is attached, the dispenser housing 14 releasably engages with the mounting plate as shown, and snaps locked into place by the tab member 30 shown. The dispenser housing 14 may then be easily removed from its installed location by inserting a key 34 into the top key slot 32, causing the mounting plate tab member 30 to release the dispenser housing 14. The dispenser housing 14 is then slidably removed from engagement with the mounting plate 20. An advertising member 26 is optionally connected to the dispenser housing 14 by sliding from the top into a groove that engages it with the dispenser housing, as shown in FIGS. 2 and 3, so as to keep the advertising member aligned with the dispenser housing regardless of the mounting disposition of the housing. The advertising member 26 also locks into the top key slot 32 on the upper surface of the dispenser housing 14.

The housing 14 of the dispenser apparatus 10 is opened with a key 34 adapted to the lock 28 mechanism When lock 28 is disengaged, the housing front cover 16 swings away from the housing back 18 to provide access to the interior of the housing, as shown in FIGS. 1 and 3. Removal of the paper retainer member 24 then allows placement of a paper towel roll (not shown) on the paper support shelf 22. The leading edge of a continuous sheet of the roll paper towel is fed through a dispensing opening 36 formed by a center opening in the paper support shelf 22 and a center opening in a lower inner surface of the housing back 18.

The paper retainer member 24 is slidably engaged on a receiving rib extending from a lower inner surface of the housing front cover 16 adjacent the dispensing opening 36, so as to position the paper retainer member to hold the leading edge of the continuous sheet of paper towels, also referred to herein as the "tail" of the roll, enclosed and protruding through the dispensing opening 36. An arrangement for the dispensing opening 36 is its association with a generally funnel shaped paper guide 42, as shown in FIGS. 1 and 3, the funnel shaped guide having its wide upper opening adjacent the roll, and its narrower lower opening serving as the dispensing outlet wherefrom a user pulls a paper towel. Those skilled in the art will recognize that such a preferred arrangement for dispensing opening 36 is only one of many possible structures which may be advantageously used and which are intended to be included in the present invention. The paper retainer 24 is then positioned so the paper tail is inserted through the funnel shaped paper guide 42 and out through dispensing opening 36, the tail of the paper thereby protruding outwardly from housing 14.

Once a paper roll is properly loaded into the dispensing apparatus 10, the front cover 16 is then closed and locked. Closing of the front cover 16 also causes the piston assembly 12 to pre-load the tension responsive to the paper, so that when the user pulls the paper tail, the paper tears at each perforation, regardless of the thickness or grade of paper used and whether the paper is 1-ply, 2-ply, or 3-ply. The front cover 16 being closed also secures the paper support shelf 22.

When the housing 14 is closed after all components are in place, including a roll of paper towels, the piston assembly 12 is pushed by the biasing member 38 into the paper tail so as to pre-load a predetermined amount of pressure to be exerted by the piston 40 on the paper as it is withdrawn by a user. The piston 40 and biasing member 38 combination is responsive to the thickness or grade of paper so that, for example, a 3-ply paper will create further push on the piston than a 1-ply paper, thereby causing the piston to apply a force relatively responsive to the paper. Likewise, the smoothness or roughness of the paper will affect to a degree the resistance offered by the piston 40 when the paper is pulled by a user, further contributing to separation of an individual sheet from the continuous sheet of roll paper towels. As best shown in FIG. 4, the piston assembly 12 employs a biasing member 38, preferably a compression coil spring as shown, to apply a force to the piston 40, pressing the piston jaw, an anterior, and generally curved surface of the piston, into the paper with an even force to thereby cause the paper to tear at each perforation. The skilled will understand that the biasing member 38 may be, not only a coil spring, but also any other device suitable for applying an effective force to the piston 40 for operational purposes of the described apparatus. As noted before, the piston assembly 12 will self-adjust to provide a sufficient force on either 1, 2, or 3-ply paper. The piston assembly 12 also includes a piston housing 46 and a piston housing cover 43, which together hold piston 40 for operation, as shown in FIG. 4.

The abrasiveness of the paper is expected to cause wear on the piston 40, the rate of wear, of course, depending on the frequency of use of the apparatus, and the thickness and surface characteristics of the paper. For this reason, the piston assembly 12 is structured to be easily replaceable, and requiring no tools for so doing. For replacing the piston assembly 12, the customer simply pulls out the piston assembly by slidably disengaging it from its mounting bracket 44, best shown in FIG. 3, and replaces it with a new piston assembly.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A dispenser for dispensing paper towels from a continuous paper towel roll wherein each individual towel is separated from an adjoining towel by a plurality of perforations, said dispenser comprising:

a dispenser housing having a housing back and a front cover hingedly connected thereto for opening and closing said housing, the dispenser housing having at least one magnet for attaching said dispenser to a ferrous metallic surface;

a dispensing opening along a periphery of said dispenser housing, said dispensing opening defined at least partly by said housing back and at least partly by said front cover; and a piston assembly comprising a biasing member and a self-adjusting non-rotating piston responsive thereto, said piston assembly including a piston housing removably connected inside said dispenser housing so that said piston contacts the tail of a paper towel roll extending through said dispensing opening.

2. The dispenser of claim 1, wherein the dispenser housing further comprises a wall mounting connector bearing the at least one magnet.

3. The dispenser of claim 1, wherein the dispenser housing further comprises a wall mounting connector member bearing the at least one magnet for attaching the dispenser to a ferrous metallic surface, said connector member being releasably engageable with said housing back.

4. The dispenser of claim 1, further comprising an advertising display member releasably engageable with said dispenser housing.

5. The dispenser of claim 1, further comprising an advertising display member releasably engageable with said dispenser housing so as to extend upwardly therefrom when engaged.

6. The dispenser of claim 1, wherein said dispenser housing further comprises a lock positioned to lock said front cover to said housing back so that said dispenser housing is securely closed.

7. The dispenser of claim 1, wherein said dispenser housing further comprises a paper support shelf forming a lower portion of said housing for thereon supporting a paper towel roll.

8. The dispenser of claim 1, wherein said front cover further comprises a rib member which supportingly contacts a paper retainer member when said front cover is closed relative to said housing back.

9. The dispenser of claim 1, wherein said biasing member comprises a compression spring.

10. A dispenser for dispensing paper towels from a continuous paper towel roll wherefrom towels are separated by tearing along perforations, said dispenser comprising:

a housing having a housing back and a front cover hingedly connected thereto for opening and closing said housing, the housing having a plurality of magnets for attaching said dispenser to a ferrous metallic surface;

a dispensing opening forming an outlet for a generally funnel shaped paper guide positioned along a lower periphery of said housing, said dispensing opening and funnel shape jointly formed by said housing back and said front cover; and a piston assembly comprising a biasing member and anon-rotating piston responsive thereto, said piston assembly being removably connected to said housing so that said piston contacts the tail of a paper towel roll extending through said dispensing opening.

11. The dispenser of claim 10, wherein the housing further comprises a wall mounting connector bearing the plurality of magnets.

12. The dispenser of claim 10, wherein the housing further comprises a wall mounting connector member bearing the plurality of magnets, said connector member being releasably engageable with said housing back.

13. The dispenser of claim 10, further comprising an advertising display member releasably engageable with said housing.

14. The dispenser of claim 10, further comprising an advertising display member releasably engageable with said housing so as to extend upwardly therefrom when engaged.

15. The dispenser of claim 10, wherein said housing further comprises a lock positioned to lock said front cover to said housing back so that said housing is securely closed.

16. The dispenser of claim 10, wherein said housing further comprises a paper support shelf forming a lower portion of said housing for thereon supporting a paper towel roll.

17. The dispenser of claim 10, wherein said front cover further comprises a rib member which supportingly contacts a paper retainer member when said front cover is closed relative to said housing back.

18. The dispenser of claim 10, wherein said piston assembly further comprises a piston housing supporting piston in responsive contact with said biasing member.

19. The dispenser of claim 10, wherein said biasing member comprises a compression spring.

20. The dispenser of claim 10, wherein said piston assembly is removably connected to said housing.

21. The dispenser of claim 10, wherein a paper retainer member abuts said paper guide and at least partly defines said general funnel shape.

* * * * *